US006116469A

United States Patent [19]

Wallays et al.

[11] Patent Number: 6,116,469

[45] Date of Patent: Sep. 12, 2000

[54] CONDIMENT SHAKER

[75] Inventors: Nele Wallays, Antwerp; Victor J. J. Cautereels, Ranst, both of Belgium

[73] Assignee: Dart Industries Inc., Orlando, Fla.

[21] Appl. No.: 09/110,579

[22] Filed: Jul. 6, 1998

[51] Int. Cl.[7] ..... A47G 19/24

[52] U.S. Cl. ..... 222/148; 222/565

[58] Field of Search ..... 222/148, 565, 222/142.1, 149, 151

[56] References Cited

U.S. PATENT DOCUMENTS

| | | | |
|---|---|---|---|
| D. 318,986 | 8/1991 | DeCoster et al. . | |
| D. 371,304 | 7/1996 | Onneweer | D9/503 |
| 1,265,562 | 5/1918 | Wessel . | |
| 1,960,674 | 5/1934 | Hopkins . | |
| 2,576,416 | 11/1951 | Randlett | 222/542 |
| 2,592,676 | 4/1952 | Franklin . | |
| 3,125,260 | 3/1964 | Dreps . | |
| 3,194,455 | 7/1965 | Castelli . | |
| 4,545,508 | 10/1985 | Crib, Jr. et al. . | |
| 4,961,521 | 10/1990 | Eckman . | |
| 5,513,776 | 5/1996 | Canini | 222/149 |

FOREIGN PATENT DOCUMENTS

| | | |
|---|---|---|
| 708344 | 7/1931 | France . |

*Primary Examiner*—Henry J. Recla
*Assistant Examiner*—Peter deVore
*Attorney, Agent, or Firm*—Taylor J. Ross

[57] ABSTRACT

A condiment shaker includes a wiper unit with multiple wiping blades releasably thread mounted to the upper end of a container and in turn overlaid by a removable perforated sprinkler top which rotates relative to the joined container and wiper unit. The wiping blades extend radially outward from a solid central hub, and pipingly engage the perforated top panel of the sprinkler top.

12 Claims, 3 Drawing Sheets

CONDIMENT SHAKER

CROSS-REFERENCE TO RELATED APPLICATIONS

This application is related to co-pending design application Ser. No. attorney docket no. 130402-D200.

STATEMENT REGARDING FEDERALLY SPONSORED RESEARCH

Not Applicable.

BACKGROUND OF THE INVENTION

Shaker dispensers for condiments such as salt and pepper are well known, as are shakers for other types of grated or comminuted foodstuffs such as cheese, coconut, nuts, and the like.

The known shakers will, in most instances, include a base container with a dispensing top having multiple sprinkler or pouring apertures therein. In some instances, as in the holder of the patent to L. J. Wessel, U.S. Pat. No. 1,265,562, issued May 7, 1918, the discharge flow of the foodstuff may be enhanced by a paddle scraper manually manipulated by a laterally projecting knob.

SUMMARY OF THE INVENTION

The shaker of the present invention is particularly adapted for the storing and serving of comminuted foodstuffs such as grated cheese, grated coconut, finely chopped nuts, and the like.

The dispensing of the foodstuff is effected through a sprinkler top with multiple apertures defined therethrough, with the discharge flow enhanced and encouraged by the shape of the apertures and by a wiper member or unit immediately underlying the sprinkler top. The assembled appearance of the condiment shaker, which includes a protective overcap to enclose the sprinkler top when the shaker is not in use, is that of a unitary aesthetically pleasing assembly with no projecting wiper manipulating components or the like. While relative rotation between the wiper member and the sprinkler top is a significant aspect of the invention, the wiper member, other than for a short portion of the peripheral skirt thereof, is concealed within the sprinkler top with the presence of the wiper member and the manner of manipulation thereof relative to the sprinkler top being neither readily discernible nor interfering with the overall appearance of the condiment shaker.

Structurally, the shaker includes a base container, normally vertically elongate with the internal storage chamber having an upwardly opening mouth defined by an externally threaded container neck. The wiper member or unit includes a peripheral skirt with radial wiper blades extending inward from the upper portion of the skirt to a central slightly domed hub. The lower portion of the wiper skirt is outwardly offset and provided with internal threads which engage the threads on the container neck and fixedly although releasable mount the wiper unit to the container for manipulation therewith.

The perforated sprinkler top overlies the upper wiping edges of the paddles or blades and includes a depending peripheral collar, the lower edge of which generally seats on an annular shoulder defined in the outwardly offset lower portion of the wiper skirt above the lower edge thereof, thus substantially concealing the wiper unit. The sprinkler top is releasably and rotatably mounted to the wiper unit by means of an inwardly directed annular bead on the inner upper portion of the sprinkler top collar which snap-fits within an annular groove formed in the outer surface of the wiper unit skirt. Thus engaged, relative rotation between the sprinkler top and the wiper unit is achieved by merely lightly grasping the sprinkler top and the base container with opposite hands, and rotating the container, with the wiper unit fixed thereto, relative to the sprinkler top. With the shaker inverted, the foodstuff will flow between the wiper blades to and through the sprinkler top apertures assisted by the rotating blades which will eliminate any tendency for the foodstuff to clog, bridge the openings, or the like. This desired free-flowing action is further enhanced by the smooth outwardly tapering configuration of each of the apertures which progressively outwardly enlarge whereby any foodstuff passing through the inner end of each openings will freely fall from the larger outer end thereof.

The sprinkler top and wiper unit, while secure in their mounted positions, are easily removable for cleaning, refilling, and the like. The entire assembly is completed by locks to the peripheral upper portion of appropriate engaging rib and groove.

Further features and advantages of the invention will become apparent from the following detailed description of the condiment shaker.

DETAILED DESCRIPTION OF THE INVENTION

Figure 1:
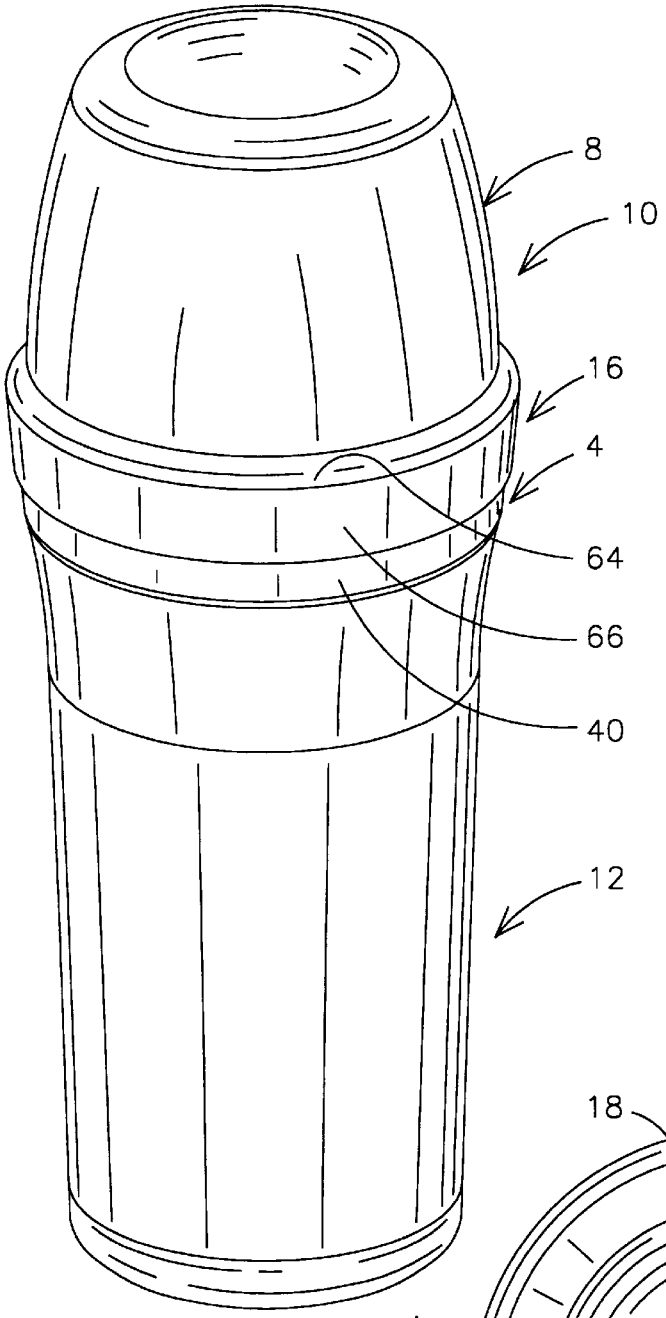
FIG. 1 is a perspective view of the condiment shaker of the invention with the overcap mounted thereon.

Referring now more specifically to the drawings, a condiment shaker 10 according to a preferred embodiment of the invention basically includes four components individually formed of an appropriate food compatible synthetic resin or resins. These components comprise a base container 12, a wiper unit 14, a sprinkler top 16, and a protective overcap 18.

The base container 12 is preferably vertically elongate defining a storage chamber 20 therein having an upwardly directed mouth 22 defined by an annular neck 24 on the container. The neck 24 includes external mounting threads 26. An upwardly directed shoulder 28 is defined immediately below the neck 24 by the upper portion of the container wall therebelow which gradually thickens outwardly to define an upper outwardly tapering wall portion. The base container 12, and more particularly the storage chamber 20 therein, has a closed bottom 30.

The wiper unit 14 includes an annular skirt 32 with integral radially inwardly extending wiper blades 34, preferably four in number and at 90 degrees of rotation relative to each other. The wiper blades 34 extend from the skirt 32 to a central upwardly domed hub 36 with the wiper blades 34 themselves, and more particularly upper wiping edges 38 thereof, upwardly curving to define an arched configuration the radius of which is less than that of the hub 36.

Figure 4:
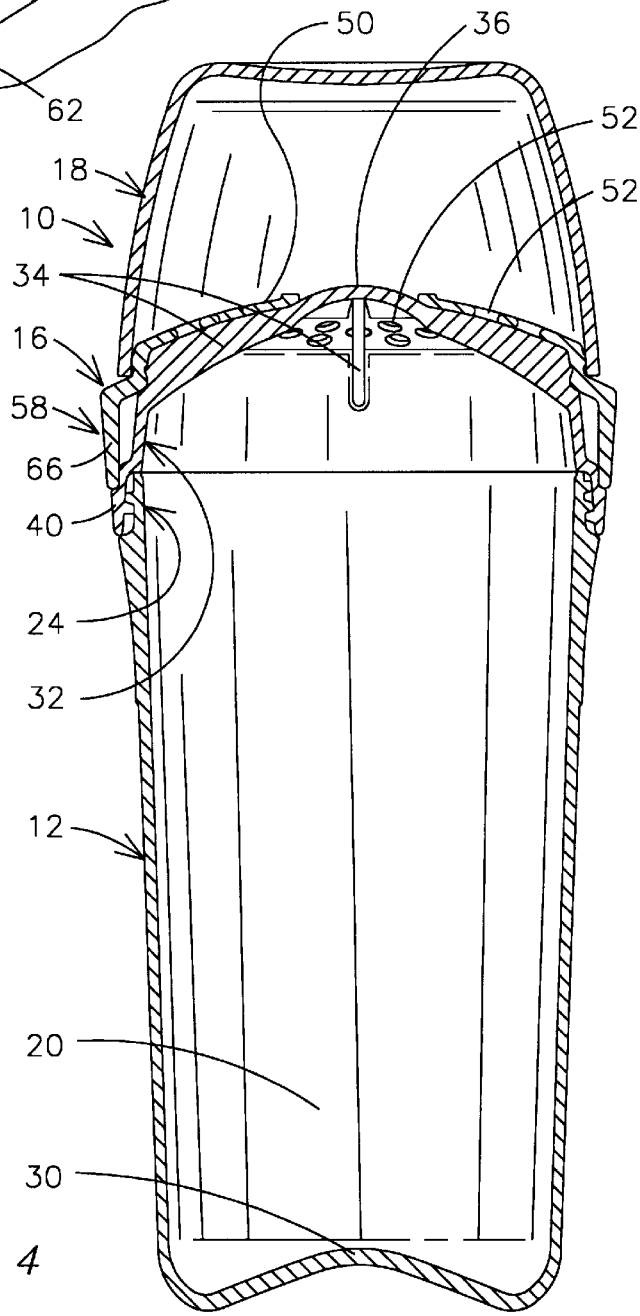
FIG. 4 is a vertical cross sectional view taken substantially on a plane passing along, line 4—4 in FIG. 2.

As will be noted from the cross sectional view of FIG. 4, the wiper blades 34 are integral with only the upper portion of the skirt 32 with the blades being of a generally tapering configuration from a maximum height at the skirt to a minimum height at the hub 36.

The lower portion of the skirt 32 is outwardly offset and defines a mounting flange 40 which includes an inwardly directed integral screw threads 42 for a screw mounting of the wiper unit 14 to and about the neck 24. The mounting flange 40 defines a downwardly directed shoulder 44 at the upper end thereof which, upon a full mounting of the wiper unit 14, seats on the upper edge of the neck 24 in sealing relation thereto. The interior of the skirt 32, above the shoulder 44, forms a generally smooth slightly inwardly tapering continuation of the interior of the base container 12, or more particularly the chamber wall.

The skirt 32, for the mounting of the sprinkler top 16 thereto as shall be explained, further includes an outer upwardly directed annular shoulder 46 formed on the outer face of the mounting flange 40 of the skirt, and an annular locking groove 48 defined within the other face of the skirt 32 immediately below the upper edge thereof and at approximately mid-height relative to the radial outer ends of the wiper blades 34.

Figure 2:
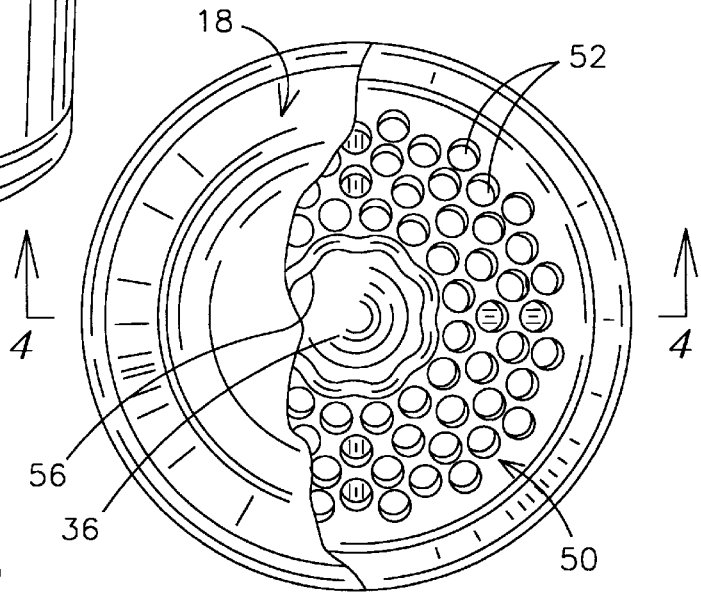
FIG. 2 is a top view of the shaker with the overcap partially broken away.
Figure 3:
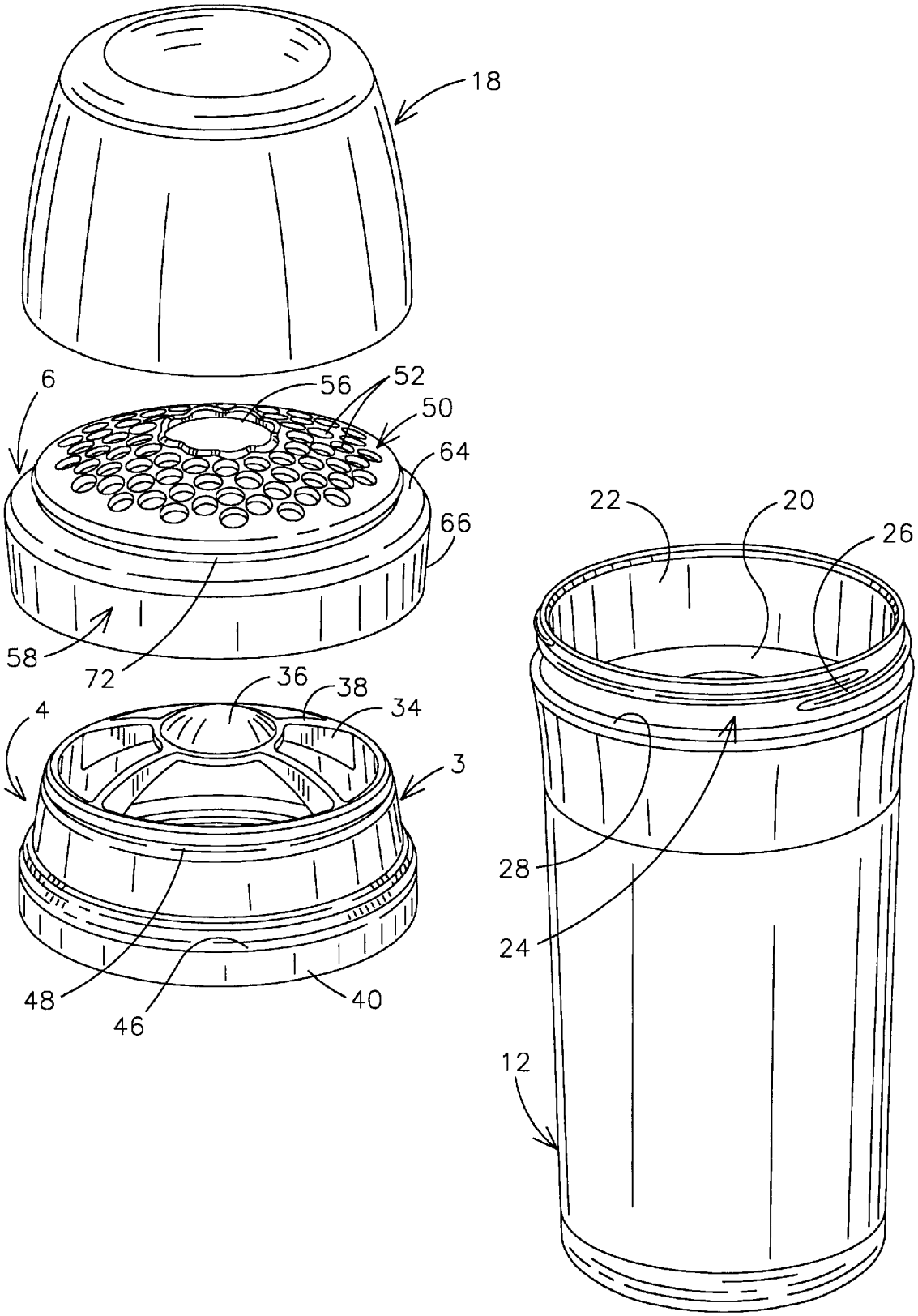
FIG. 3 is an exploded perspective view of the separate releasably mountable components of the condiment shaker.
Figure 5:
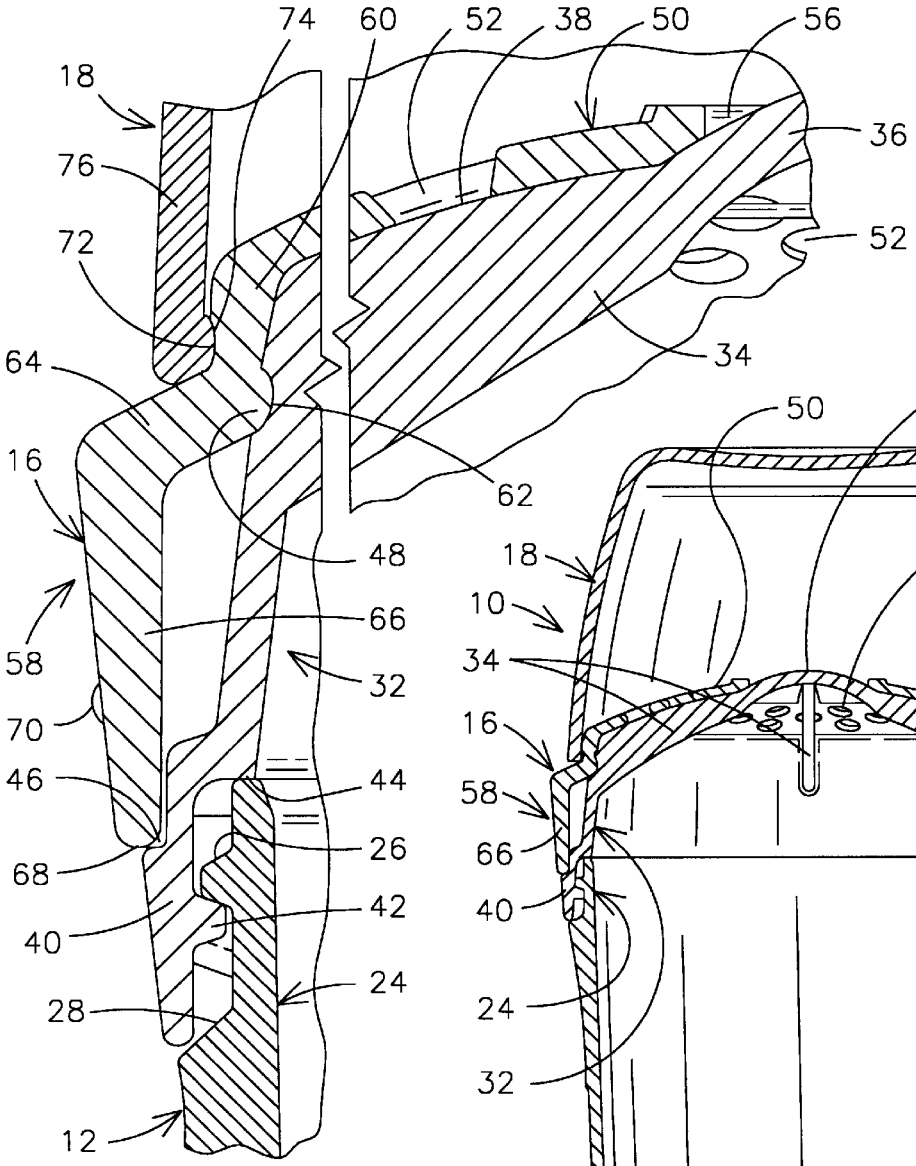
FIG. 5 is an enlarged cross sectional detail illustrating the mounted relationship between the various components of the condiment shaker.

The sprinkler top 16 includes a slightly domed or upwardly arcing upper panel 50 which conforms to the arc of the upper edges of the wiper blades 34 and, when mounted, seats in engaging relation thereon. The degree of engagement between the upper wiping edges 38 of the wiper blades 34 and the undersurface of the upper panel 50 of the sprinkler top 16 being such as to wipe the undersurface of the upper panel 50 clean of any food product particles which might tend to interfere with free discharge. The actual discharge of the grated or otherwise comminuted food products is effected through multiple apertures 52 in the top panel 50. These apertures 52, as will be noted in FIG. 2, are preferably arranged in concentric circles with the apertures of one annular row slightly interesting between the apertures the adjacent annular rows. Further, noting the cross sectional detail of FIG. 5, each of the apertures 52 tapers outwardly to provide for a greater circular area progressively outward from the inner end of each aperture to the outer discharge end thereof. Thus, any material moving from the storage chamber 20 into the apertures will easily discharge.

The wiper blades 34, and in particular the upper wiping edges 38 thereof, while wiping about the inner surface of the upper panel 50, encourage movement of the comminuted cheese or the like through the restricted inner ends of the apertures 52, and prevent any bridging of the cheese across the inner ends of the apertures. This avoidance of bridging, in conjunction with the outward enlarging of the apertures to avoid internal bridging within the apertures as would occur with straight wall apertures, ensures the proper discharge of the material.

The center of the upper panel 50 includes a central cutout 56, which may have scalloped edges as illustrated, and is of a size as to receive the domed hub 36 of the wiper unit 14 therein and partially therethrough. Inasmuch as substantially no wiping action will occur at the center of the upper plate 50 by the wiper blades 34, this might encourage a collection and spoilage of grated cheese or the like at the center of the upper panel 50. To prevent this, any tendency of the grated cheese or the like to move to the center of the upper panel 50 is eliminated by closing off this central portion by the hub 36. In other words, the hub 36, snugly engages within the cutout 56 and against the under surface of the upper panel 50 peripherally thereabout, to ensure that any of the food product engaging the inner surface of the upper panel 50, does so only in the path of the wiper blades 34.

Noting the cross sectional details in particular, the sprinkler top 16 includes a mounting and handling collar 58 integral with the outer periphery of the upper panel 50 and depending therefrom for encircling engagement about the wiper unit 14 and skirt 32 thereof. An upper portion 60 of the collar 58 is closely received about the upper end of the skirt 32 and includes an inwardly directed arcuate annular rib 62 which snap-locks within the locking groove 48, due to inherent resiliency within the material used, for free rotating of the sprinkler top 16 relative to the wiper blades 34.

At a point substantially aligned with the annular rib 62, the collar 58 includes an integral outwardly inclined flange 64 which in turn terminates in a downward and slightly inwardly angled lower portion 66 of the collar 58. A lower edge 68 of this lower portion 66 terminates at or immediately above the shoulder 46 on the mounting flange 40 of the skirt 32. In this manner, a relatively smooth outer surface appearance is provided by the stacked components, including the upper portion of the base container 12, the exposed mounting flange 40 of the skirt 32, and the lower portion 66 of the collar 58. It will also be noted that the only intimate engagement of the sprinkler top 16 with the wiper unit 14 is at the nested upper portions thereof whereat the rib 62 is snugly yet slidably received within the locking groove 48 of the skirt 32, thereby ensuring minimal resistance to free movement between the sprinkler top 16 and wiper unit 14. In order to assist in the relative rotation between the sprinkler top 16 and wiper unit 14, as shall be explained presently, a plurality of small shallow gripping projections 70 can be provided at spaced points peripherally about the lower portion 66 of the collar 58.

In order to protect the contents of the condiment shaker during periods of non-use, the protective overcap 18 will mount over the sprinkler top 16 peripherally about the upper panel 50. This mounting is effected by a locking of the protective overcap 18 to the upper portion 60 of the collar 58 by means of an annular outwardly directed groove 72 in the upper portion 60 immediately above the flange 64. This groove 72 in turn receives an inwardly directed annular rib 74 formed on the lower edge of a skirt portion 76 of the protective overcap 18.

In use, the base container 12 of the condiment shaker is filled through the mouth 22 thereof, after which the wiper unit 14 is screw threaded onto the neck 24 of the base container, and the sprinkler top 16 is snap mounted to the wiper unit 14. Disassembly for refilling, cleaning of the components, and the like, is easily effected by first removing the sprinkler cap 16 and then unscrewing the wiper unit 14. If desired, as for merely refilling the storage chamber 20, the sprinkler cap 16 can be removed together with the wiper unit 14 by merely unscrewing the wiper unit 14 from the container neck 24.

When the comminuted or grated food product is to be dispensed, the protective overcap 18 is removed, and the base container 12 is held in one hand and inverted. The other hand grasps the collar 58 of the sprinkler top 16, and the sprinkler top and base container are rotated relative to each other, normally by rotating the base container, with the wiper unit 14 fixed thereon, relative to the sprinkler top 16. As previously noted, this will produce the desired wiping action of the upper wiping edges 38 against the inner surface of the upper panel 50, encouraging flow of the food product through the apertures 52, avoiding any tendency of the material to bridge, and the like.

In dispensing, the joined base container 12 and wiper unit 14 are preferably rotated, relative to the sprinkler top 16, so as to enhance the threaded engagement between the wiper unit 14 and the base container 12. Should rotation in the opposite direction be desired, or should one desire to use a reciprocating movement, the user can stabilize the joinder of the wiper unit 14 to the neck 24 by merely placing one finger of the hand holding the container against the exposed mounting flange 40 of the skirt 32.

While a single embodiment has been disclosed, it is to be appreciated that all obvious variations thereof, as may fall within the scope of the claims following hereinafter, are intended to be encompassed.

What is claimed is:

1. A condiment shaker for the dispensing of a food product, said shaker comprising:

base container with an storage chamber and a mouth defined by an upper edge of said base container, said base container being adapted to be hand held and rotated, a wiper unit overlying said mouth, said wiper unit including a circular skirt with upper and lower edges, a central hub in inwardly spaced relation to and coaxial with said skirt, and multiple wiping blades extending radially between said skirt and said hub, said wiping blades each having an upper wiping edge arcing inwardly and upwardly from said skirt at the upper edge thereof, means for releasably fixing said wiper unit to said container for rotation therewith, a sprinkler top overlying said wiper unit, said sprinkler top having inner and outer faces with multiple discharge holes and a central opening therethrough, said multiple discharge holes communicating with said chamber, said opening being substantially larger than the individual discharge holes and closely receiving said hub therethrough, and means for releasably mounting said sprinkler top to said container and wiper unit for rotation of said container and wiper unit relative to said sprinkler top, said upper wiping edges of said wiping blades being in direct wiping engagement with said inner face of said sprinkler top and moving thereacross upon rotating of said container and wiper unit relative to said sprinkler top.

2. The condiment shaker of claim 1 wherein said means for mounting said sprinkler top to said container and wiper unit comprises an external groove peripherally about said wiper unit and a groove-engaging inwardly directed rib on said sprinkler top.

3. The condiment shaker of claim 2 wherein said means for fixing said wiper unit to said container comprises cooperating threads on said container and said wiper unit.

4. The condiment shaker of claim 3 including a protective overcap releasably overlying and enclosing said discharge holes in said sprinkler top.

5. The condiment shaker of claim 1 wherein said wiper unit skirt including a radially outwardly offset lower portion defining a downwardly directed inner shoulder seating on the upper edge of said container peripherally thereabout.

6. The condiment shaker of claim 5 wherein said sprinkler top includes a top panel through which said holes are defined and an integral depending peripheral collar, said top panel overlying said wiping blades, and said collar encircling and enclosing said wiper unit skirt downward from said top panel to a point wherein said collar partially overlaps said outwardly offset portion of said wiper unit skirt whereby a portion of said skirt below said wiping unit collar remains exposed.

7. The condiment shaker of claim 1 wherein said means for mounting said sprinkler top to said container comprise an external groove peripherally about said wiper unit and a groove-engaging inwardly directed rib on said sprinkler top.

8. The condiment shaker of claim 1 including a protective overcap releasably overlying and enclosing said discharge holes in said sprinkler top.

9. A discharge assembly for a condiment shaker for allowing and encouraging flow of grated and comminuted foodstuffs therefrom, said discharge assembly including:

a sprinkler top including a top panel having multiple openings defined therethrough and a depending collar peripherally joined to said top panel, said collar having a free lower edge, an inwardly directed rib formed on said collar in closely spaced relation below said top panel and above said lower edge of said collar; and a wiper unit comprising a peripheral skirt immediately inward of said collar and extending from said sprinkler top panel to a point in spaced relation below said sprinkler collar, a peripheral outwardly directed groove defined in said wiper unit skirt and receiving said collar rib therein for rotation of said sprinkler top and wiper unit relative to each other, said wiper unit further including a central hub and multiple wiping blades extending between said skirt and said hub, said top panel of said sprinkler tog including an enlarged central opening receiving said hub therethrough, said hub sealing said central opening and defining a central rotational axis for said sprinkler top and said wiper unit, and said blades being in wiping engagement with said top panel of said sprinkler top for a wiping thereof as said sprinkler top and wiper unit are rotated relative to each other.

10. The assembly of claim 9 wherein said top panel of said sprinkler top includes inner and outer faces, each of said holes being of a progressively greater cross section outward from said inner face to said outer face for unencumbered discharge therethrough.

11. The assembly of claim 9 wherein said sprinkler top is slightly upwardly domed, and said blades include upper wiping edges conforming to the domed configuration of said top panel.

12. The assembly of claim 11 wherein each of said blades is of a progressively lesser height from said skirt and radially inward toward said hub.

* * * * *